United States Patent [19]

Grundfest

[11] 4,255,612

[45] Mar. 10, 1981

[54] INSULATOR FOR COVERING ELECTRIC CABLES

[75] Inventor: Michael A. Grundfest, Forest Hills, N.Y.

[73] Assignee: Thomas & Betts Corporation, Raritan, N.J.

[21] Appl. No.: 42,538

[22] Filed: May 25, 1979

[51] Int. Cl.[3] ..... H01R 9/07

[52] U.S. Cl. ..... 174/88 R; 174/117 FF; 174/117 A

[58] Field of Search ..... 174/88 R, 117 F, 117 FF, 174/117 A

[56] References Cited

U.S. PATENT DOCUMENTS

| | | | |
|---|---|---|---|
| 2,191,544 | 2/1940 | Ruskin | 174/88 R |
| 3,466,384 | 9/1969 | Martin | 174/88 R X |
| 3,960,430 | 6/1976 | Bunnell et al. | 174/88 R X |
| 4,143,931 | 3/1979 | Skare et al. | 174/117 FF X |

*Primary Examiner*—Roy N. Envall, Jr.

*Attorney, Agent, or Firm*—James J. Daley; Robert M. Rodrick; Jesse Woldman

[57] ABSTRACT

An insulator for covering an electric cable has recesses for receiving any portions of a connector which extend beyond a surface of the cable covered by the insulator. If the connector extends between overlapping portions of a pair of cables, the connector and the overlapping portions of the cables can be completely enveloped by sandwiching them between a pair of insulators.

40 Claims, 4 Drawing Figures

INSULATOR FOR COVERING ELECTRIC CABLES

FIELD OF THE INVENTION

The present invention relates to insulators for covering electric cables and, more particulary, to such insulators which are especially adapted for use in connection with flat multiconductor cables.

BACKGROUND OF THE INVENTION

In copending U.S. patent application Ser. No. 042,709, filed on May 25, 1979, and entitled "Flat Cable and Installation Method", which is owned by the assignee of the present invention, there is disclosed a technique for connecting flat multiconductor cables. The specification of that copending application is incorporated into this specification by reference thereto herein.

Briefly, the method disclosed in that copending application involves overlapping a pair of flat multiconductor cables and then mechanically and electrically connecting the overlapping portions of the cables using metallic connectors which extend beyond the surface of at least one of the cables. Any connector which electrically connects two hot, i.e. electrically energized, conductors also becomes electrically energized and therefore potentially dangerous, inasmuch as an individual who touches the connector, either directly or indirectly, could receive a serious electric shock.

In order to electrically insulate the connectors, it has been proposed to cover them with a flat sheet of relatively flexible electric insulation. Because the cable is designed for undercarpet installation, it is undesirable to use a thick sheet of insulation which might, due to its thickness, create lumps in the carpet. However, if the thickness of the insulation is decreased to prevent the formation of lumps in the overlying carpet, the insulation is more susceptible to puncture or piercing by the relatively sharp edges of the connectors when the carpet above is walked on.

Pierced or punctured insulation results in the same potentially hazardous condition that exists when the connectors are not covered by any insulation whatsoever. Moreover, the piercing or puncturing of the insulation increases the possibility of eventual tracking or arcing between the partially exposed connectors.

SUMMARY OF THE INVENTION

The present invention overcomes many of the disadvantages and shortcomings of the devices discussed above by providing an insulator with a spacer which supports electric insulation a distance from an adjacent surface of an electric cable and accommodates protruding portions of any connectors which extend beyond the surface of the cable. The distance between the insulation and the surface of the cable may be selected so as to inhibit the connectors from cutting into the insulation, thereby preserving the integrity of the insulation to avoid the safety and tracking problems discussed above.

In one especially advantageous embodiment, the spacer is made from a relatively noncompressible material having a plurality of openings therein. The noncompressibility of the spacer permits it to have a thickness which is approximately equal to the distance that the connectors extend beyond the surface of the cable, thereby maintaining as low a profile as possible to inhibit the formation of lumps in an overlying carpet. Each of the openings is adapted to receive a corresponding one of the connectors. By making the spacer from an electric insulating material, portions of the spacer interposed between adjacent connectors can function as a barrier to further inhibit tracking between the connectors.

Another aspect of the invention involves sandwiching overlapping portions of a pair of cables, which are electrically connected to each other by at least one connector, between a pair of insulators. Each of the insulators is sized and shaped so as to completely cover and overhang the overlapping portions of the cables. Interfaced overhanging portions of the insulators are attached together so as to envelop the overlapping portions of the cables, thereby inhibiting moisture and other foreign substances from getting between the overlapping portions of the cables and contacting the connectors.

BRIEF DESCRIPTION OF THE DRAWINGS

For a more complete understanding of the invention, reference may be had to the following description of an exemplary embodiment taken in conjunction with the accompanying figures of the drawings, in which.

DESCRIPTION OF EXAMPLARY EMBODIMENTS

Figure 1:
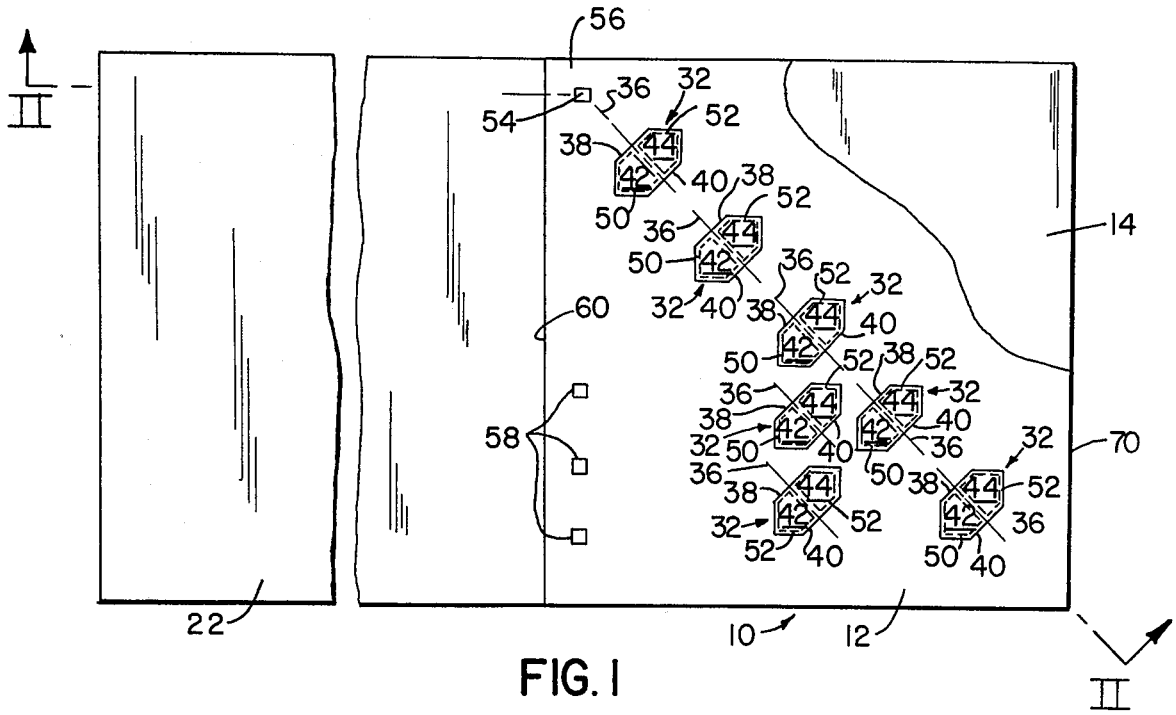
FIG. 1 is a top plan view of one embodiment of an insulator constructed in accordance with the present invention, a portion of the insulator being broken away to facilitate consideration and discussion.
Figure 2:
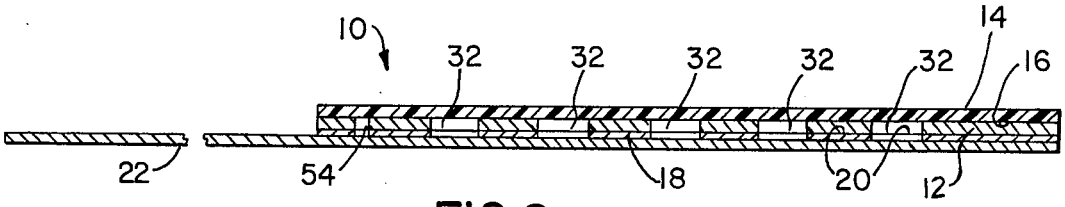
FIG. 2 is a cross-sectional view, taken along line II—II in FIG. 1 and looking in the direction of the arrows, of the insulator shown in FIG. 1.

With reference to FIGS. 1–4, in which like elements are designated by the same reference numerals, there is shown an insulator 10 including a spacer 12, a thin clear film of electric insulation 14 laminated to one face 16 of the spacer 12, a layer of pressure-sensitive adhesive 18 applied to an opposite face 20 of the spacer 12, and a liner 22 removably attached to the adhesive 18.

The spacer 12 is preferably made from a relatively noncompressible, electric insulating material, such as polyvinylchloride. Spacer 12 is sized and shaped so as to completely cover and overhang overlapping portions 24, 26 of a pair of flat multiconductor cables 28, 30, respectively (see FIGS. 3 and 4). Although the spacer 12 is shown as being square in FIG. 1, it can have any other suitable shape depending upon the configuration of the overlapping portions 24, 26 of the cables 28, 30, respectively.

A plurality of holes 32 extend through the spacer 12 between the faces 16, 20 thereof. The holes 32 are sized, shaped, and arranged so as to receive connectors 34 (see FIGS. 3 and 4) which electrically and mechanically connect the overlapping portions 24, 26 of the cables 28, 30. Tracking between the connectors 34 is inhibited by the spacer 12.

The connectors 34 may be any suitable electric-conductor such as is disclosed in copending U.S. patent application Ser. No. 042,441, filed on May 29, 1979 and entitled "Self-Locking Clamp Member," which is owned by the assignee of the present invention. The specification of that copending application is incorporated into this specification by reference thereto herein.

Each of the holes 32 has an elongated hexagonal shape which is symmetrical about a line 36 perpendicular to and bisecting the two opposite parallel sides 38, 40 of the holes 32, so that each of the holes 32 is divided into two longer mirror-image portions 42, 44 (see FIG. 1). Each of the portions 42, 44 has a generally pentagonal shape which matches the pentagonal shape of at least one of a pair of arms 46, 48 of a corresponding one of the connectors 34 (see FIGS. 3 and 4), so that each of the connectors 34 can be arranged in a corresponding one of the holes 32 in either of two different orientations 50, 52 (indicated by dotted lines in FIG. 1) with respect to the line 36. The size and shape of the holes 32 may be varied depending upon the size and shape of the connectors 34.

A single substantially square aperture 54 is arranged in one corner 56 of the spacer 12. This square aperture 54 extends through the pressure-sensitive adhesive 18 and release paper 22 as well unless they are both made of clear materials. No similar aperture is required in insulation 14 because it is clear, which also permits an inspector to view the connectors 34 to determine that they are the correct connectors and properly installed. In the event that insulation 14 is not clear, then a similar aperture would be required in insulation 14. A series of three substantially square apertures 58 extend along an edge 60 of the spacer 12 in alignment with each other and the aperture 54. The apertures 54, 58 are designed for automatically registering the holes 32 with the connectors 34, for instance, by aligning the aperture 54 with two intersecting edges 62, 64 of the cables 28, 30 respectively, (see FIG. 3) and then aligning at least one of the apertures 58 with the edge 62 of the cable 28. Markings or locating lugs on the face 20 of the spacer 12 can be used in place of the apertures 54, 58.

The film 14 of electric insulation can be made from any suitable material, such as a laminate of polyvinylchloride and polyester adapted for lamination to the spacer 12. Alternatively, the film 14 can be formed monolithically with the spacer 12.

In order to prevent the film 14 from being pierced or punctured by the arms 48 (see FIG. 4) of the connectors 34, the film 14 is supported a predetermined substantially fixed distance from the arms 46, 48 of the connectors 34 by the spacer 12. The thickness of the spacer 12 may be varied to vary the distance between the film 14 and the arms 46, 48 of the connectors 34, as long as the film 14 is positioned above the arms 46, 48 of the connectors 34 so as to avoid being cut by the arms 46, 48 of the connectors 34.

The liner 22 prevents the inadvertent sticking of the pressure-sensitive adhesive 18 to the cables 28, 30 or other objects. Preferably, the liner 22 is made from a piece of clear plastic, so that the apertures 54, 58 can be easily observed through the liner 22.

Figure 4:
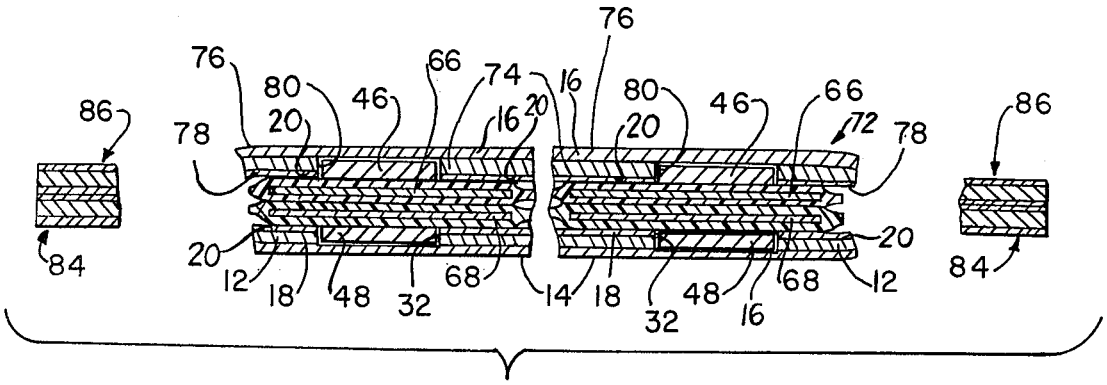
FIG. 4 is a cross-sectional view of the insulator-cable combination shown in the exploded view of FIG. 3, the cross-section being taken along a diagonal line similar to the line II—II in FIG. 1.
Figure 3:
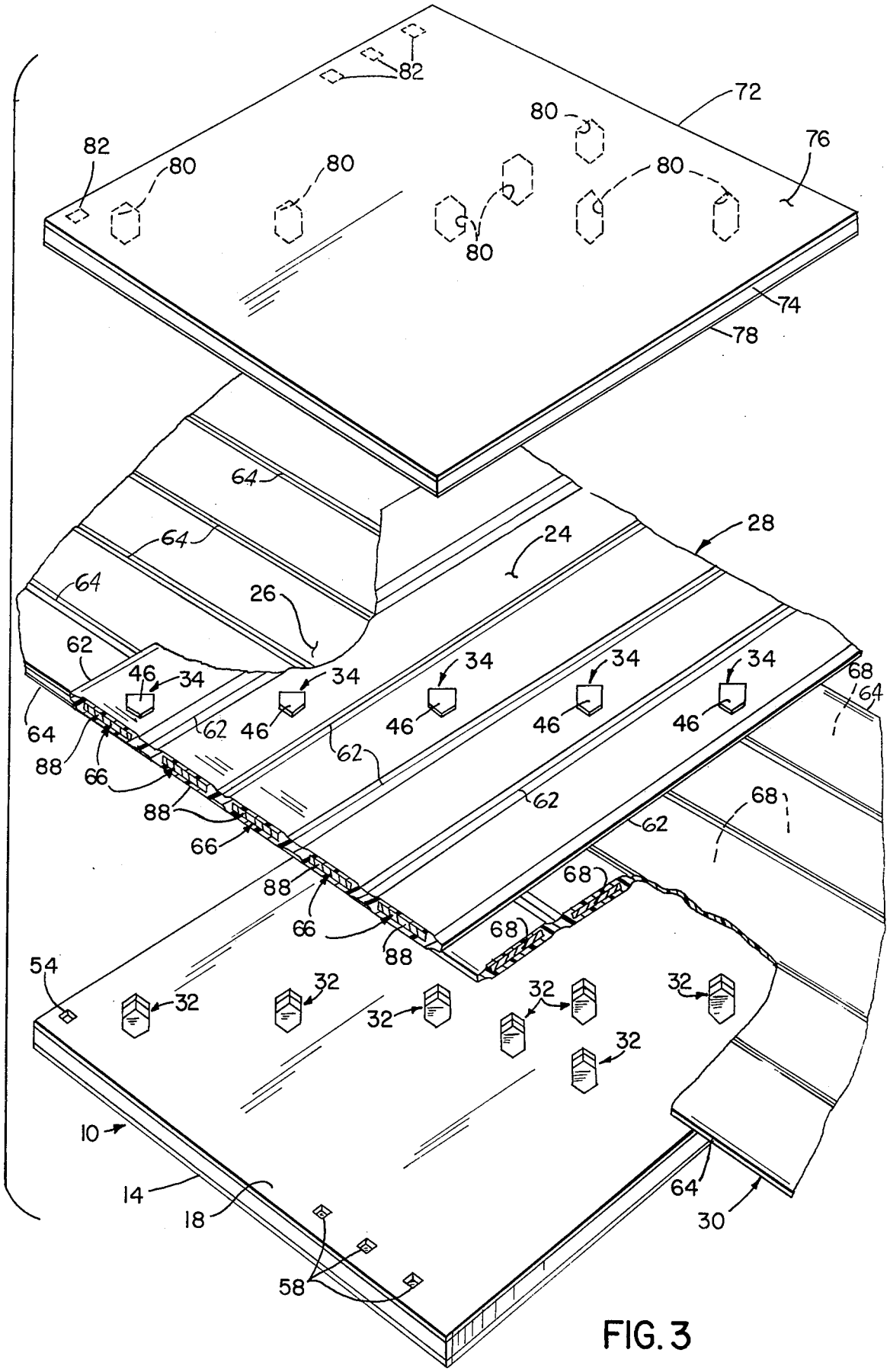
FIG. 3 is an exploded view of one embodiment of an insulator-cable combination construction in accordance with the present invention.

FIGS. 3 and 4 illustrate a typical tap splice in which the cables 28, 30 are arranged perpendicular to each other. The cable 28 has five electric conductors 66, each of which is electrically and mechanically connected to a corresponding one of five electric conductors 68 of the cable 30 by a respective one of the connectors 34. The five connectors 34 extend diagonally across the overlapping portions 24, 26 of the cables 28, 30 respectively.

When applying the insulator 10 to the overlapping portion 26 of the cable 30, the liner 22 is bent back onto itself in such a manner that a portion of the liner 22 extends beyond an edge 70 of the spacer 12. The portion of the liner 22 extending beyond the edge 70 of the spacer 12 is then pulled a distance sufficient to expose a portion of the pressure-sensitive adhesive 18 located adjacent to the edge 60 of the spacer 12, so that a corresponding portion of the spacer 12 can be attached to the overlapping porition 26 of the cable 30 by the exposed portion of the pressure-sensitive adhesive 18. Further pulling of the liner 22 exposes the remainder of the pressure-sensitive adhesive 18 on the face 20 of the spacer 12, so that the insulator 10 can be adhesively attached over its entire length to the overlapping portion 26 of the cable 30.

If the insulator 10 is properly installed, the arms 48 of the connectors 34 will register with five of the holes 32 which are aligned diagonally across the face 20 of the spacer 12 (see FIG. 1). The other two of the holes 32, which along with the middle one of the five diagonally aligned holes are aligned laterally or longitudinally across the face 20 of the spacer 12, may be used when insulating a tap splice between five-conductor electric cable and three-conductor electric cable. For instance, any one of the three laterally or longitudinally aligned holes may register with a connector 34 which selectively connects one conductor of a three-conductor cable to one of three corresponding conductors of a five-conductor cable. Of course, the number and arrangement of the holes 32 may be varied depending upon the configuration of the connectors 34.

As shown in FIGS. 3 and 4, another insulator 72 is applied to the overlapping portion 24 of the cable 28. The insulator 72, which is identical to the insulator 10, includes a spacer 74, a thin film of electric insulation 76, and a layer of pressure-sensitive adhesive 78. The spacer 74 has a plurality of openings 80 for receiving the arms 46 of the connectors 34 and a plurality of apertures 82 used, when necessary, to properly align the insulator 72 during its application to the overlapping portion 24 of the cable 28.

When the insulators 10, 72 have been properly installed, overhanging portions 84 of the insulator 10 are adhered to overhanging portions 86 of the insulator 72 by the pressure-sensitive adhesives 18, 78 (see FIG. 4). The adhered insulators 10, 72 cooperate so as to completely envelop exposed ends 88 of the conductors 66, the connectors 34, and the overlapping portions 24, 26, of the cables 28, 30, respectively.

To minimize any effects of pinhole passages through the insulators 10, 72 which could act as capillary tubes to conduct moisture to the interspace between the cables 28, 30, the interior surfaces of the overlapping portions 24, 26 may be coated with a filler material such as a mastic to completely seal the cables 28, 30. This filler provides a total solid insulation between the cables 28, 30, tends to cause any moisture that enters the interspace to be pocketed, and provides some pressure relief for forces applied downwardly, directly on the joint. If the filler is a pressure-sensitive adhesive, it can additionally be used to temporarily set the cables 28, 30 with respect to one another and permit their being handled as a single unit during later installation of the connectors.

It will be understood that the embodiments described herein are merely exemplary and that a person skilled in the art may make many variations and modifications without departing from the spirit and scope of the invention. For instance, the insulator of the present invention may be applied to round electric cable as well as flat electric cable. Also, the insulator is equally suitable for use in covering any overlapped portions of a pair of electric cables which are spliced together by, for example, a butt splice or any other type of splice. All such modifications and variations are intended to be included within the scope of the invention as defined in the appended claims.

I claim:

1. An insulator for insulating the juncture between two or more electric conductors where the connector used to join such conductors extends above the surface of the surrounding joined electric conductors a first predetermined height comprising: a plurality of spacer means each having second predetermined heights above the surrounding joined electric conductors, said second predetermined heights being greater than said first predetermined height, said spacer means at least partially surrounding the connector used to join the electric conductors and spaced apart sufficiently to receive such connector therebetween; and insulation means engaging a first surface of said spacer means and supported over said connector when said spacer means are positioned adjacent a connector.

2. An insulator as defined in claim 1 wherein an adhesive layer is placed on the second surface of said spacer means to adhere said spacer means to the electric conductors adjacent a connector.

3. An insulator as defined in claim 2 wherein the surface of said adhesive layer not engaging the second surface of said spacer means is engaged by a liner means removably attached to said adhesive layer for preventing the inadvertent adhesion of said adhesive layer to another object until said liner means is removed from said adhesive layer.

4. An insulator as defined in claim 4, wherein said liner means is made of plastic and having a length which is more than twice the length of the juncture between the electric conductors.

5. An insulator as defined in claim 1 wherein said insulation means is transparent to permit positioning said insulator over a connector.

6. An insulator as defined in claim 1 further comprising indicia means to properly locate said insulator with respect to said juncture.

7. An insulator as defined in claim 1, wherein one of said spacer means has an aperture therein to permit positioning said insulator over a connector.

8. An insulator as defined in claim 1 wherein one of said spacer means has an aperture therein and said insulation means is transparent to permit positioning said insulator over a connector.

9. An insulator as defined in claim 1, wherein one of said spacer means has an aperture therein and further spacer means have further apertures therein to permit said insulator to be aligned with the juncture of two of the electric cables and further of the electric conductors.

10. An insulator as defined in claim 1, wherein said spacer means are fabricated from noncompressible electrical insulation material.

11. An insulator as defined in claim 1 wherein said insulation means is formed monolithically with said spacer means.

12. An insulator as defined in claim 6 wherein said indicia includes a plurality of markings.

13. An insulator as defined in claim 6 wherein said indicia includes a plurality of projections.

14. An insulator as defined in claim 1 wherein said plurality of spacer means fully surrounds the connector used to join the electric conductors.

15. An insulator as defined in claim 14 wherein said plurality of spacer means are positioned about said connector so that the resulting recess takes a shape similar to the exposed portion of the connector used to join the electric conductors.

16. An insulator for insulating a prescribed pattern of individual junctures between prescribed conductors of two or more multi-conductor electric cables, each juncture being made by electrical connectors which extend above the surface of the surrounding electric conductors a first predetermined height, comprising: spacer means defining a plurality of apertures equal to and positioned according to each possible connector position in joining individually each of the conductors of one electric cable to the conductors of the other electric cable, said spacer means having a second predetermined height greater than said first predetermined height, said apertures each arranged to receive a different one of the connectors therein; and insulation means engaging a first surface of said spacer means and supported over said connectors when said spacer means are positioned adjacent said connectors.

17. An insulator as defined in claim 16 wherein said apertures are similar in shape to the exposed portions of the connectors.

18. An insulator as defined in claim 16 wherein said apertures are similar in shape to the exposed portions of the connectors and larger than such connectors so that no part of the spacer means is in contact with such connector.

19. An insulator as defined in claim 16 wherein at least one aperture is symmetrical about an imaginary line of symmetry which divides said at least one aperture into a first portion on one side of said line of symmetry and a second portion on the opposite side of said line of symmetry, one of said first and second portions having a shape similar to the shape of the exposed portions of the connectors.

20. An insulator as defined in claim 16 wherein an adhesive layer is placed on the second surface of said spacer means to adhere said spacer means to the electric conductors adjacent a connector.

21. An insulator as defined in claim 20 wherein the surface of said adhesive layer not engaging the second surface of said spacer means is engaged by a liner means removably attached to said adhesive layer for preventing the inadvertent adhesion of said adhesive layer to another object until said liner means is removed from said adhesive layer.

22. An insulator as defined in claim 21 wherein said liner means is made of plastic and having a length which is more than twice the length of the juncture between the electric cables.

23. An insulator as defined in claim 16 wherein said insulation means is transparent to permit positioning said insulator over the connectors.

24. An insulator as defined in claim 16 further comprising indicia means to properly locate said insulator with respect to said juncture.

25. An insulator as defined in claim 16 wherein said spacer means further defines an aperture extending from said first surface to a second surface to permit positioning said insulator over the connectors.

26. An insulator as defined in claim 16 wherein said spacer means further defines an aperture extending from said first surface to a second surface and said insulation means is transparent to permit positioning said insulator over the connectors.

27. An insulator as defined in claim 16 wherein said insulation means defines an aperture from said first surface to a second surface and said insulation means defines further apertures from said first surface to a second surface to permit said insulation to be aligned with the juncture of two of the electric cables and further of the electric conductors.

28. An insulator as defined in claim 27 where the spacing of said further apertures substantially matches the spacing of the conductors within one of the electric cables.

29. An insulator as defined in claim 16 wherein said spacer means is fabricated from noncompressible electrical insulating material.

30. An insulator as defined in claim 16 wherein said insulation means is formed monolithically with said spacer means.

31. An insulator as defined in claim 24 wherein said indicia includes a plurality of markings.

32. An insulator as defined in claim 24 wherein said indicia includes a plurality of projections.

33. An insulator as defined in claim 16 wherein a first group of said apertures lie along a diagonal line so as to overlie the juncture of all of the conductors individually with an associate conductor of a second cable placed orthogonally to said first cable.

34. An insulator as defined in claim 33 wherein a second group of said apertures, including one of said first group of apertures, lie along a line perpendicular to the longitudinal edge of an electric cable to permit the juncture of specific electric conductors of a first electric cable with specific conductors of a second electric cable.

35. In combination, a first multi-conductor cable and a second multi-conductor cable having common overlapping portions and with specific conductors of said first multi-conductor cable joined to specific conductors of said second multi-conductor cable by means of electrical connectors which extend above the surfaces of the surrounding electrical conductors by first predetermined heights; and a pair of insulators positioned so as to sandwich said overlapping portions of said first and second multi-conductor cables therebetween, each of said insulators being sized and shaped so as to completely cover and overhang said overlapping portions of said first and second multi-conductor cables, interfaced overhanging portions of said insulators being attached to one another to envelop at least one connector and said overlapping portions of said first and second multi-conductor cables.

36. A combination according to claim 35 wherein said interfaced overhanging portions of said insulators are attached to each other by a pressure-sensitive adhesive.

37. A combination according to claim 35 further comprising indicia means for properly locating at least one of said insulators with respect to said overlapping portions of said cables.

38. A combination according to claim 35 wherein each of said insulators defines at least one aperture for receiving a portion of said at least one connector which extends above an adjacent surface of said overlapping portions of said cables.

39. In combination, an electric cable having at least one electrical connector, extending portions of said at least one connector extending beyond opposite surfaces of said electric cable, and a pair of insulators arranged to sandwich said cable therebetween, each of said insulators including insulation means for covering said at least one connector, and spacer means for spacing said insulating means a predetermined distance above the adjacent cable and above the extending portion of said at least one connector.

40. A combination according to claim 35 further comprising a filler material inserted between said first and second multi-conductor cables at the common overlapping portions thereof.

* * * * *

Disclaimer 4,255,612.—*Michael A. Grundfest,* Forest Hills, N.Y. INSULATOR FOR COVERING ELECTRIC CABLES. Patent dated Mar. 10, 1981. Disclaimer filed Aug. 5, 1983, by the assignee, *Thomas & Betts Corp.*

Hereby enters this disclaimer to claims 1 through 34 and 38 through 40 of said patent.

[*Official Gazette April 10, 1984.*]